US008928531B2

(12) United States Patent
Hu et al.

(10) Patent No.: US 8,928,531 B2
(45) Date of Patent: Jan. 6, 2015

(54) ANTENNA MODULE

(75) Inventors: Pei-Cheng Hu, New Taipei (TW); Kuo-Chang Su, New Taipei (TW); Wen-Yi Tsai, New Taipei (TW)

(73) Assignee: Wistron Corp., New Taipei (TW)

( * ) Notice: Subject to any disclaimer, the term of this patent is extended or adjusted under 35 U.S.C. 154(b) by 183 days.

(21) Appl. No.: 13/427,816

(22) Filed: Mar. 22, 2012

(65) Prior Publication Data

US 2012/0242546 A1 Sep. 27, 2012

(30) Foreign Application Priority Data

Mar. 25, 2011 (TW) ..... 100110322 A

(51) Int. Cl.

| | |
|---|---|
| ***H01Q 1/38*** | (2006.01) |
| ***H01Q 1/24*** | (2006.01) |
| ***H01Q 5/00*** | (2006.01) |
| ***H01Q 9/04*** | (2006.01) |

(52) U.S. Cl.

CPC ..... *H01Q 1/243* (2013.01); *H01Q 5/0055* (2013.01); *H01Q 9/0421* (2013.01)

USPC ..... 343/700 MS; 343/702

(58) Field of Classification Search

CPC ..... H01Q 1/38; H01Q 1/243; H01Q 9/0421

USPC ..... 343/700 MS, 702, 846

See application file for complete search history.

(56) References Cited

U.S. PATENT DOCUMENTS

| | | | | |
|---|---|---|---|---|
| 6,252,552 | B1 * | 6/2001 | Tarvas et al. | 343/700 MS |
| 6,366,243 | B1 * | 4/2002 | Isohatala et al. | 343/700 MS |
| 7,626,551 | B2 * | 12/2009 | Chien et al. | 343/700 MS |
| 2003/0179144 | A1 | 9/2003 | Takesako et al. | |
| 2006/0164304 | A1 * | 7/2006 | Huang et al. | 343/700 MS |
| 2006/0279463 | A1 * | 12/2006 | Milyakh | 343/700 MS |
| 2006/0290569 | A1 * | 12/2006 | Boyle | 343/700 MS |
| 2007/0171128 | A1 * | 7/2007 | Chen | 343/700 MS |
| 2009/0140942 | A1 * | 6/2009 | Mikkola et al. | 343/767 |
| 2012/0139813 | A1 * | 6/2012 | Anguera et al. | 343/858 |

FOREIGN PATENT DOCUMENTS

| | | | |
|---|---|---|---|
| CN | 1519982 | A | 8/2004 |
| CN | 101499557 | A | 8/2009 |
| CN | 101673871 | A | 3/2010 |
| TW | M363088 | U1 | 8/2008 |
| TW | 200847520 | | 12/2008 |
| TW | M349563 | | 1/2009 |

OTHER PUBLICATIONS

China Patent Office, Office Action, Patent Application Serial No. 201110085861.0, Dec. 2, 2013, China.

Taiwan Patent Office, Office Action, Patent Application Serial No. 100110322, Apr. 24, 2014, Taiwan.

China Patent Office, Office Action, Patent Application Serial No. 201110085861.0, Jun. 16, 2014, China.

Taiwan Patent Office, Office Action, Patent Application Serial No. 100110322, Jul. 15, 2014, Taiwan.

* cited by examiner

*Primary Examiner* — Hoanganh Le

(57) ABSTRACT

An antenna module is provided. The antenna module includes a radiator, a feed conductor, a ground element, a ground conductor and a short conductor. The feed conductor is connected to the radiator. The ground conductor connects the radiator to the ground element. The short conductor connects the feed conductor to the ground conductor.

7 Claims, 7 Drawing Sheets

ANTENNA MODULE

CROSS REFERENCE TO RELATED APPLICATIONS

This Application claims priority of Taiwan Patent Application No. 100110322, filed on Mar. 25, 2011, the entirety of which is incorporated by reference herein.

BACKGROUND OF THE INVENTION

1. Field of the Invention

The present invention relates to an antenna module, and in particular relates to an antenna module with increased impedance bandwidth.

2. Description of the Related Art

Conventional planar inverted F antennas include a feed conductor, a radiator, a ground element and a short element. The radiator is connected to the feed conductor. The short element connects to the radiator and the ground element. Conventionally, the short element grounds an end of the radiator to improve impedance matching. However, conventional design has poor impedance matching effect, and cannot satisfy increasing requirement of bandwidths.

BRIEF SUMMARY OF THE INVENTION

An antenna module is provided, includes a radiator, a feed conductor, a ground element, a ground conductor and a short conductor. The feed conductor is connected to the radiator. The ground conductor connects the radiator and the ground element. The short conductor connects the feed conductor and the ground conductor.

In the embodiments of the invention, a short path is built by the short conductor which is separated from the radiator. A capacitance effect is formed between the short conductor and the radiator (equivalent capacitance in series with the radiator), and an inductance effect is formed between the short conductor and the ground element (equivalent inductance in parallel connected with the ground element) to reduce imaginary parts of impedance and to increase impedance bandwidth. The transmission bands of the antenna modules of the embodiments of the invention conform to the GSM850/900/DCS/PCS, UMTS BAND 1/BAND 2/BAND 5/BAND 8,802.11 a/b/g standards.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
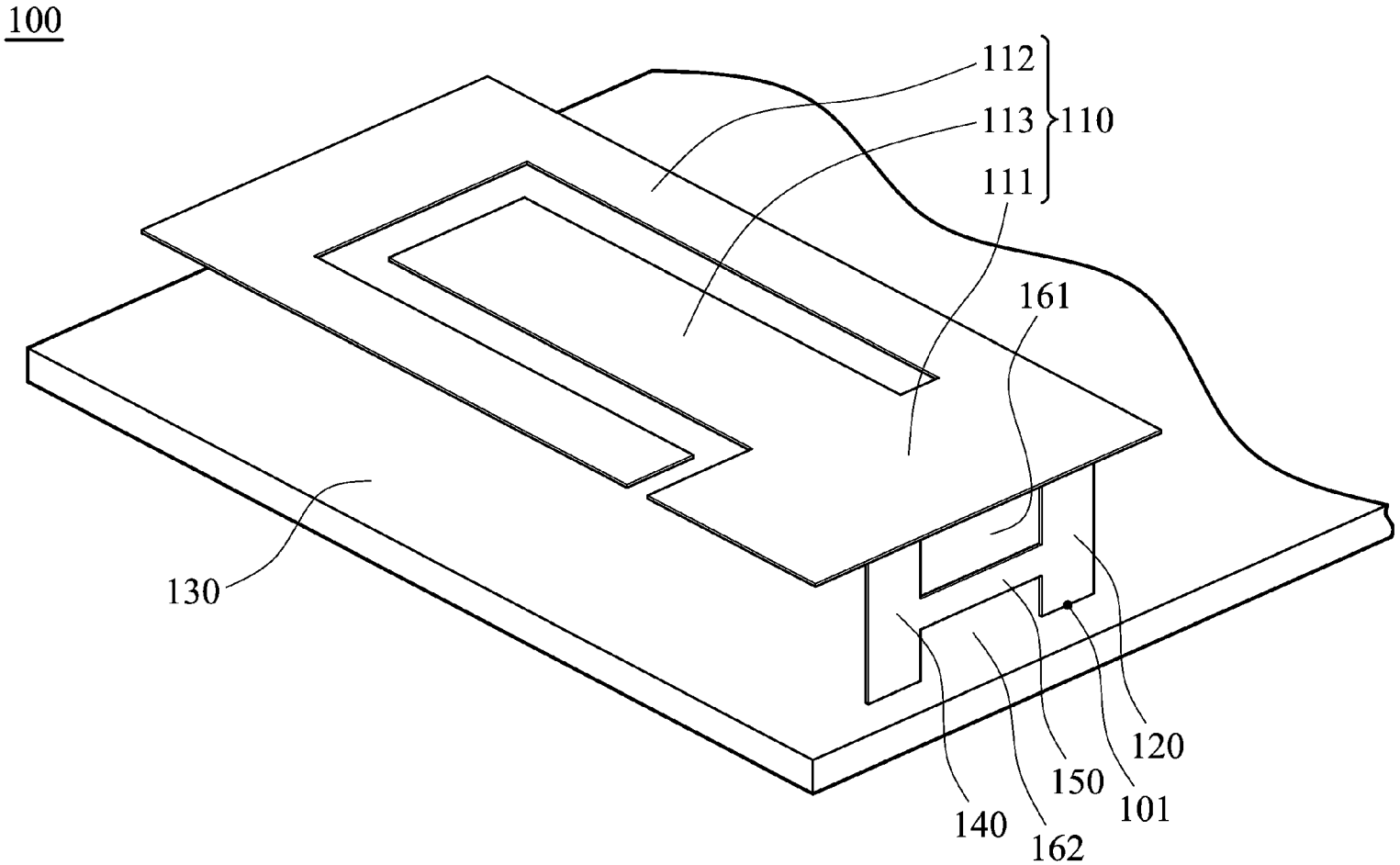
FIG. 1 shows an antenna module of a first embodiment of the invention.

FIG. 1 shows an antenna module 100 of a first embodiment of the invention, including a radiator 110, a feed conductor 120, a ground element 130, a ground conductor 140 and a short conductor 150. The feed conductor 120 is connected to the radiator 110. The ground conductor 140 connects to the radiator 110 and the ground element 130. The short conductor 150 connects to the feed conductor 120 and the ground conductor 140. The feed conductor 120 is separated from the ground element 130. A signal is fed to the feed conductor 120 via a feed point 101.

In this embodiment, the ground conductor 140 is parallel to the feed conductor 120. The radiator 110 is parallel to the ground element 130. The short conductor 150 is respectively perpendicular to the ground conductor 140 and the feed conductor 120.

The radiator 110 includes a first section 111, a second section 112 and a third section 113. The second section 112 is connected to the first section 111. The third section 113 is connected to the first section 111. The ground conductor 140 and the feed conductor 120 are respectively connected to the first section 111. The second section 112 is U shaped. The third section 113 is longitudinal. The second section 112 surrounds the third section 113. The second section 112 transmits a low band signal (824 MHz~960 MHz), and the third section 113 transmits a high band signal (1710 MHz~2170 MHz).

A gap is formed between the short conductor 150 and the first section 111. The short conductor 150, the feed conductor 120, the ground conductor 140 and the first section 111 form a first opening 161. The short conductor 150, the feed conductor 120, the ground conductor 140 and the ground element 130 form a second opening 162. The first opening 161 is quadrilateral, for example, a rectangular.

Figure 2:
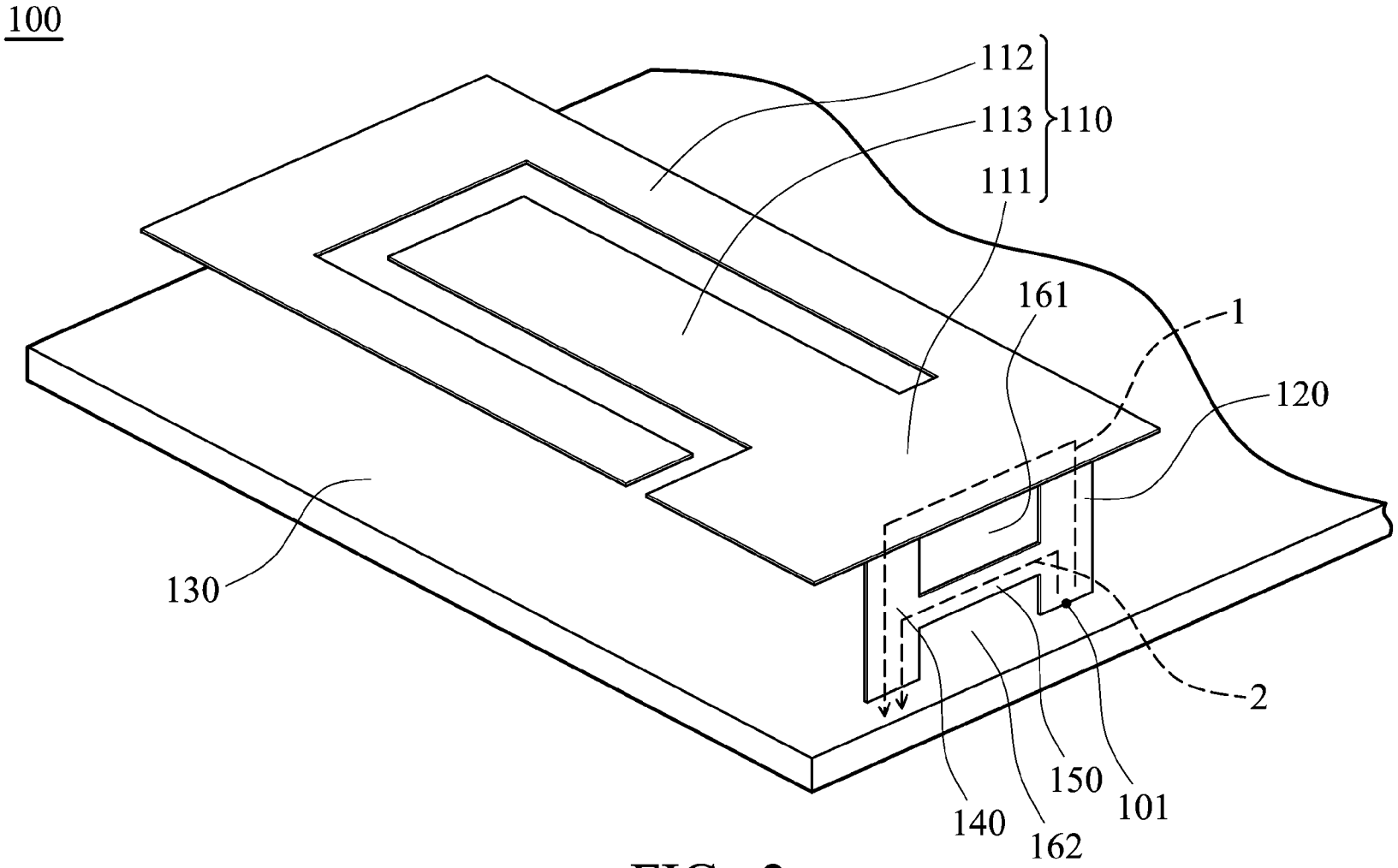
FIG. 2 shows a ground path and a short path of the antenna module of the embodiment of the invention.
Figure 3:
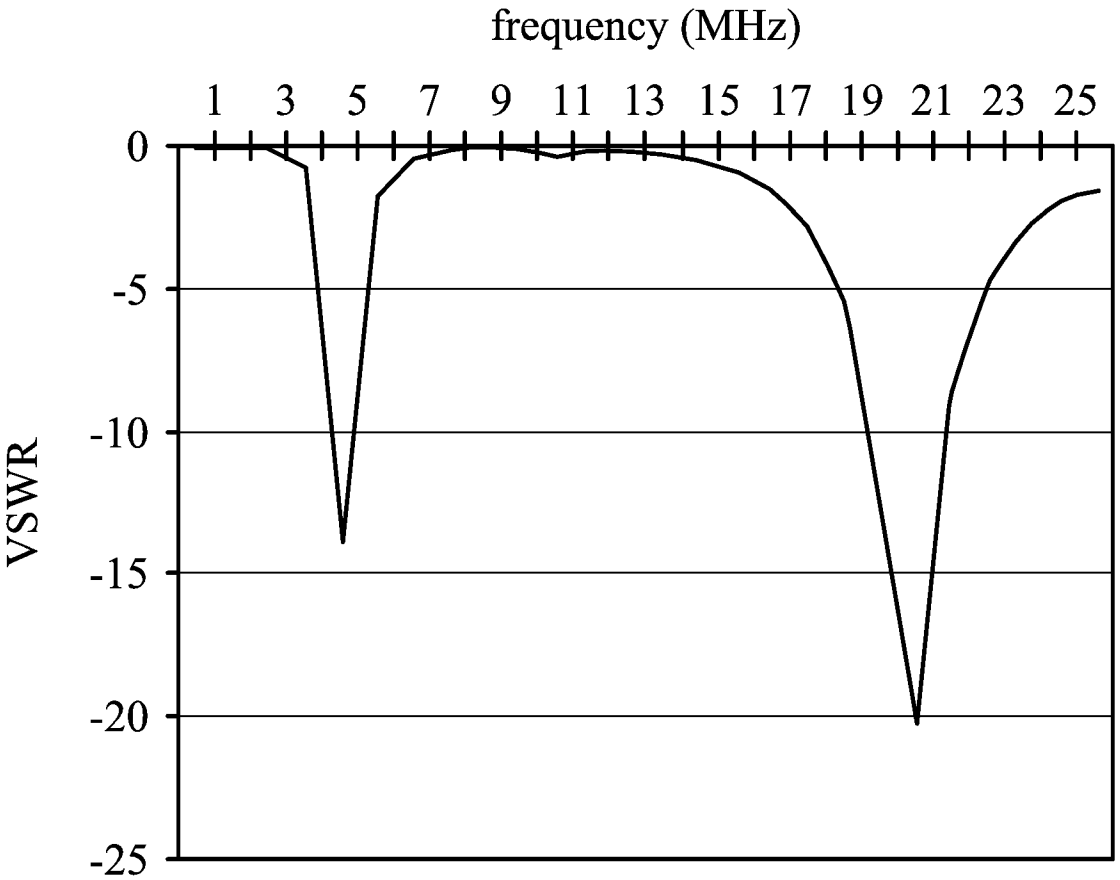
FIG. 3 shows return loss of the antenna module of the embodiment of the invention.

FIG. 2 shows a ground path 1 and a short path 2 of the antenna module 100 of the embodiment of the invention. In the embodiment of the invention, the short path 2 is built by the short conductor 150 which is separated from the radiator 110. A capacitance effect is formed between the short conductor 150 and the radiator 110 (equivalent capacitance in series with the radiator), and an inductance effect is formed between the short conductor 150 and the ground element 130 (equivalent inductance in parallel connected with the ground element) to reduce imaginary parts of impedance and to increase impedance bandwidth. FIG. 3 shows return loss of the antenna module 100 of the first embodiment of the invention, wherein the antenna module 100 of the first embodiment provides improved impedance matching for low frequency bands and increased impedance bandwidth. The transmission bands of the antenna modules of the embodiments of the invention conform to the GSM850/900/DCS/PCS, UMTS BAND 1/BAND 2/BAND 5/BAND 8,802.11 a/b/g standards.

In the embodiment, the inductance effect generated by the short conductor 150 can be modified by changing the width of the short conductor 150. The capacitance effect generated by the short conductor 150 can be modified by changing an included angle between the short conductor 150 and the feed conductor 120 or an included angle between the short conductor 150 and the ground conductor 140 (in this embodiment a distance between the short conductor 150 and the radiator 110 is about 2~3 mm).

Figure 4:
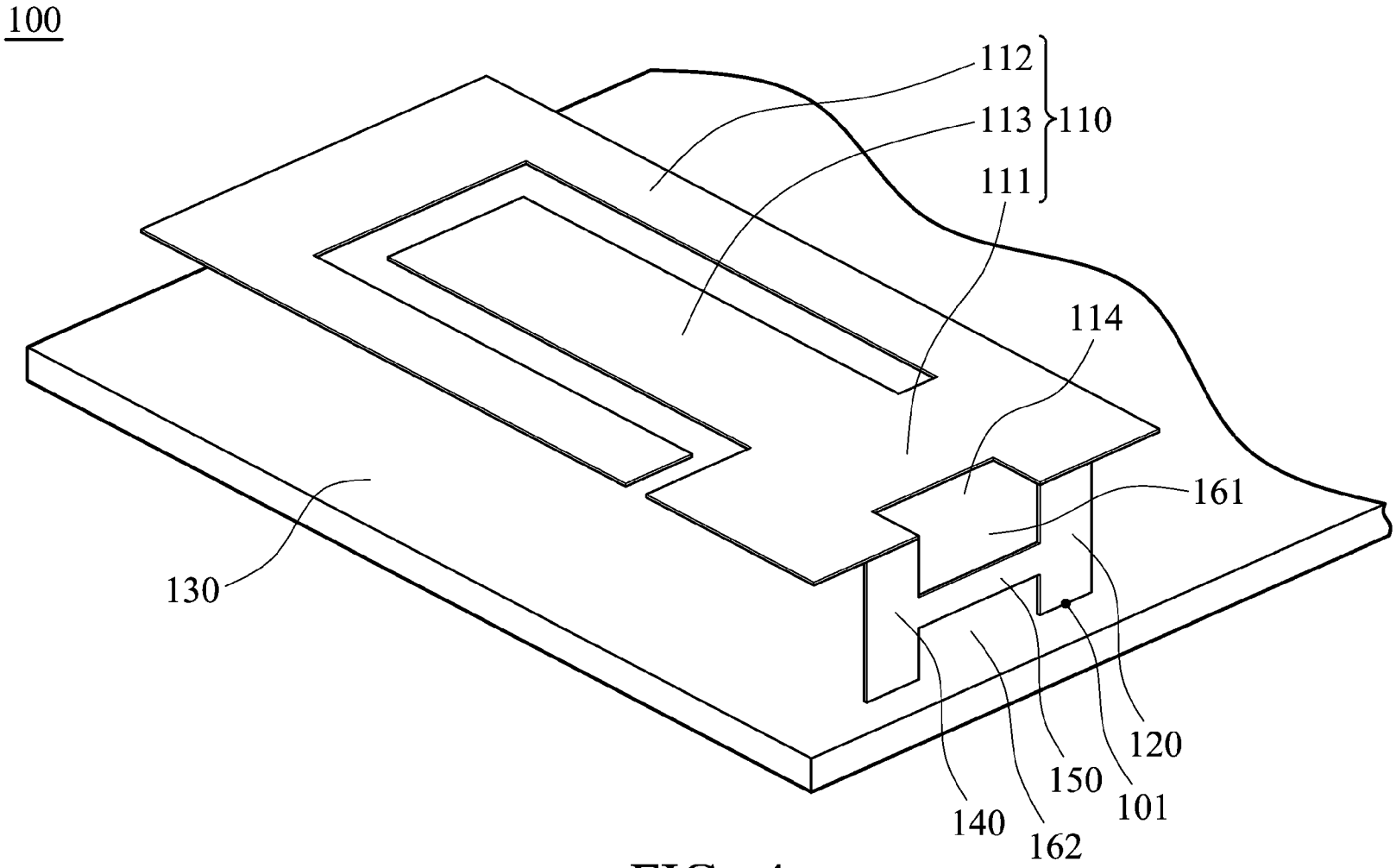
FIG. 4 shows a modified example of the first embodiment of the invention.

FIG. 4 shows a modified example of the first embodiment of the invention, wherein the first section 111 has a notch 114, and the notch 114 is connected to the first opening 161. The notch 114 can further adjust the impedance matching of the antenna module 100.

Figure 5:
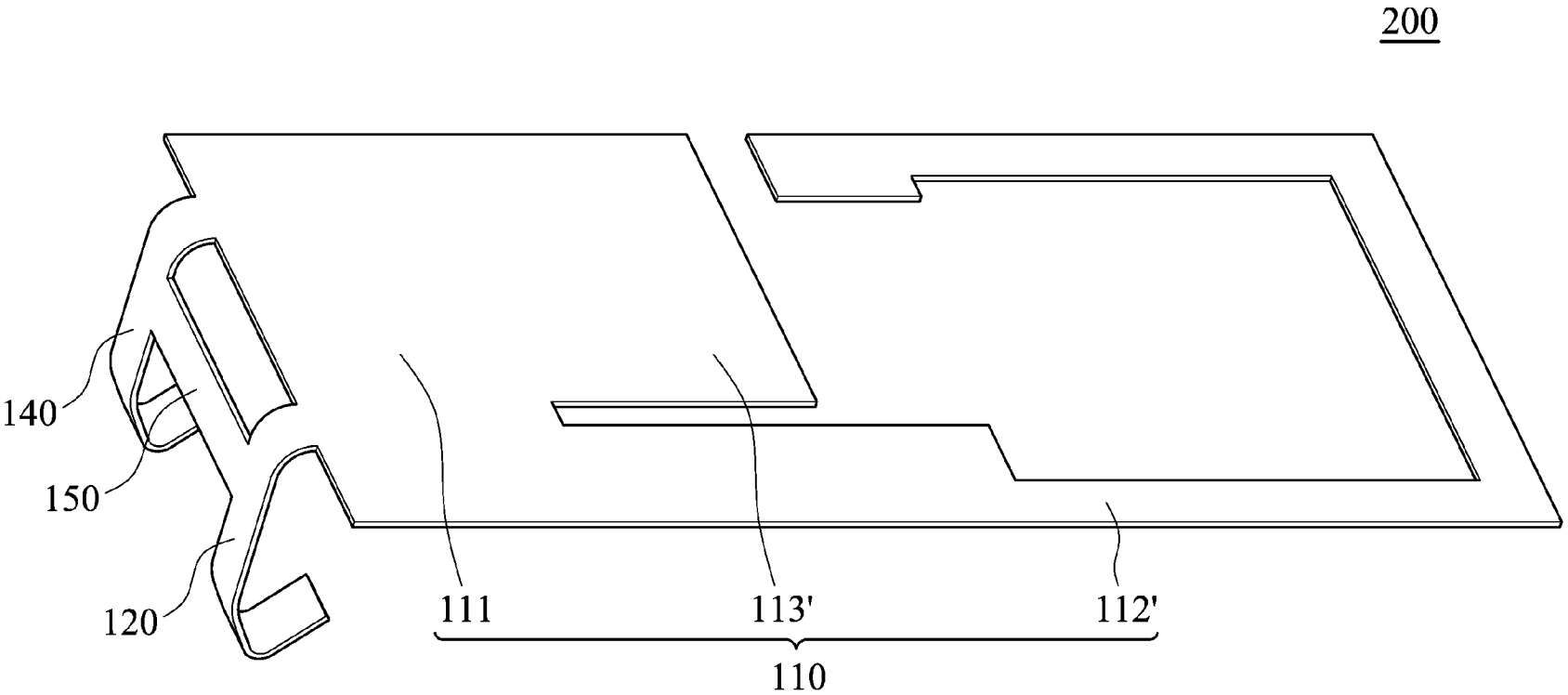
FIG. 5 shows an antenna module of a second embodiment of the invention.

FIG. 5 shows an antenna module 200 of a second embodiment of the invention, wherein the shape of the third section 112' is modified, and the second section 112' does not surround the third section 113'. In the invention, the shape of the radiator can be modified, and the radiators disclosed in the embodiments do not restrict the invention.

Figure 6:
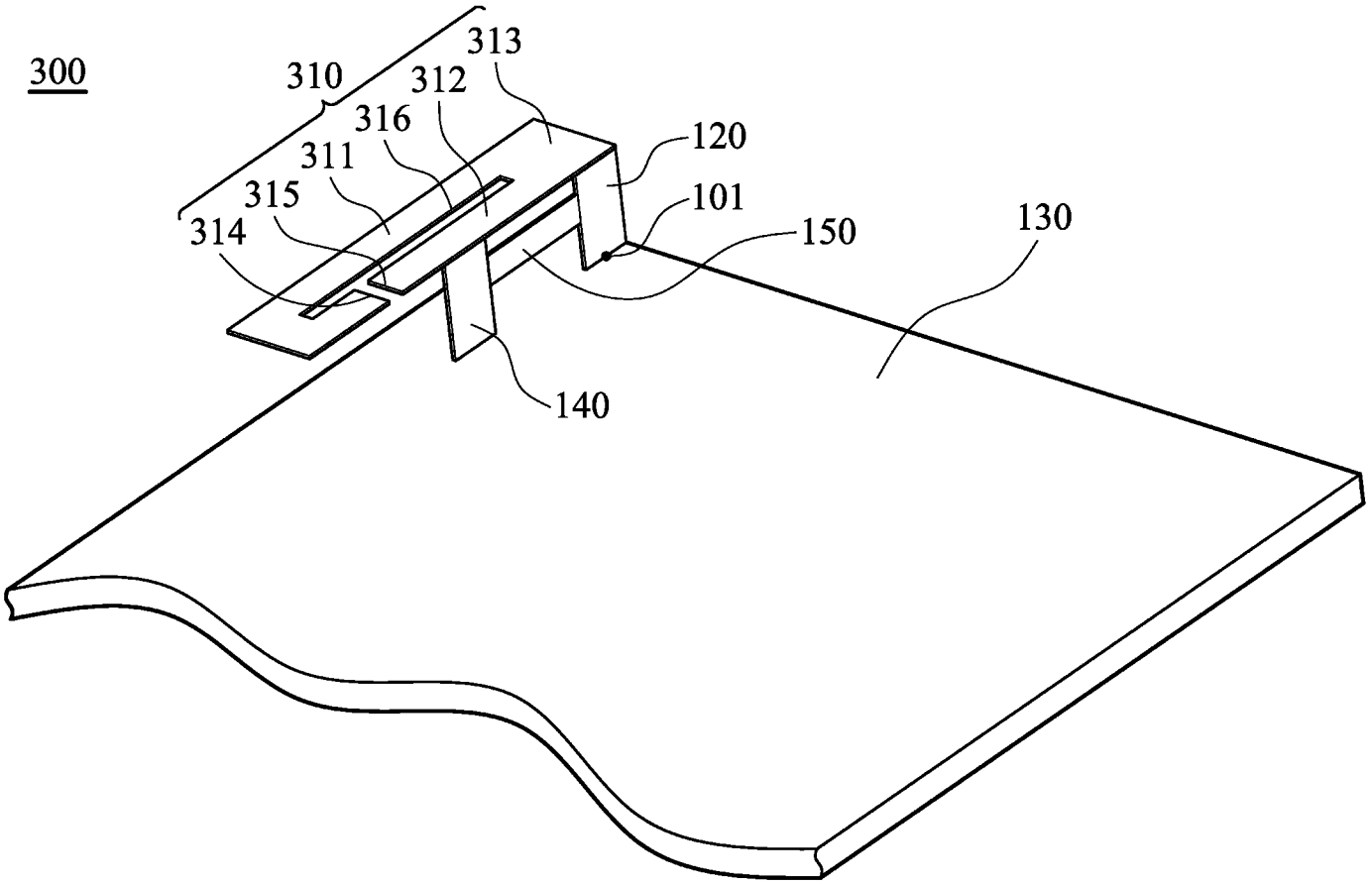
FIG. 6 shows an antenna module of a third embodiment of the invention.
Figure 7:
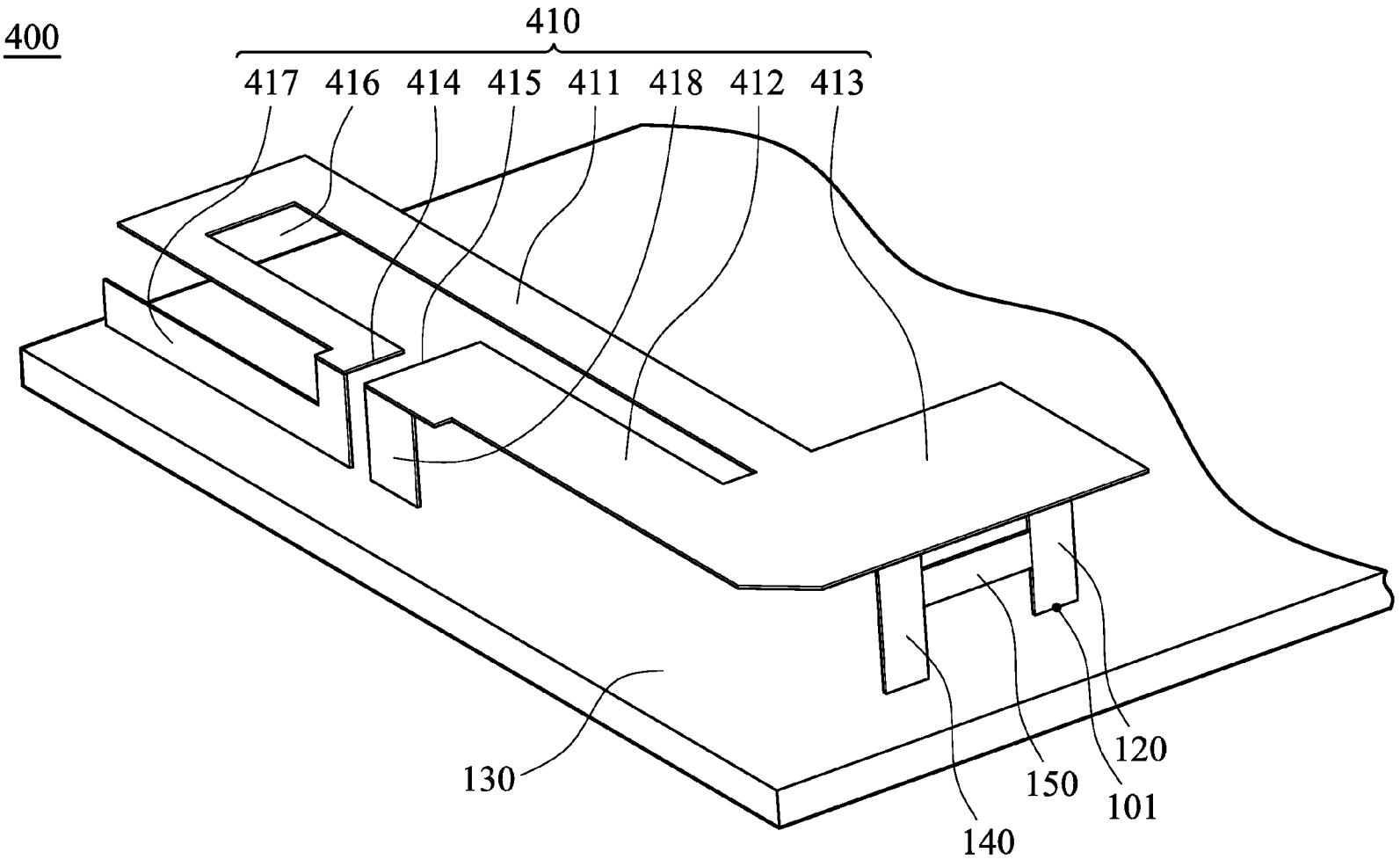
FIG. 7 shows an antenna module of a fourth embodiment of the invention.

FIG. 6 shows an antenna module 300 of a third embodiment of the invention, and FIG. 7 shows an antenna module 400 of a fourth embodiment of the invention. The antenna module 300 of the third embodiment differs from the first embodiment in the design of the radiator 310. The radiator 310 comprises a first section 311, a second section 312 and a third section 313, the first section 311 is connected to the third section 313, and the second section 312 is connected to the third section 313, wherein the first section 311 is L shaped and the first section 311 comprises a first free end 314, wherein the second section 312 is longitudinal and the second section 312 comprises a second free end 315, and the first free end 314 faces the second free end 315, and a T shaped groove 316 is formed on the radiator 310, and the T shaped groove 316 is defined by the first section 311, the second section 312 and the third section 313. The ground conductor 140 is connected to the second section 312. The antenna module 400 of the fourth embodiment differs from the first embodiment in the design of the radiator 410. The radiator 410 comprises a first section 411, a second section 412 and a third section 413, the first section 411 is connected to the third section 313, and the second section 412 is connected to the third section 413, wherein the first section 411 extends away from the third section 413 in a first direction, then turns in a second direction perpendicular to the first direction, and then turns back in a third direction opposite to the first direction to a first free end 414, wherein the second section 412 extends longitudinally from the third second 413 to a second free end 415, and the first free end 414 faces the second free end 415, and a T shaped groove 416 is formed on the radiator 410, and the T shaped groove 416 is defined by the first section 411, the second section 412 and the third section 413. The radiator 410 further comprises a first extension section 417 and a second extension section 418, the first extension section 417 is connected to the first free end 414, and the second extension section 418 is connected to the second free end 415, the first extension section 417 is L shaped, the second extension section 418 extends longitudinally from the second free end 415, and the first extension section 417 and the second extension section 418 are located on a first plane perpendicular to the ground element 130. The ground conductor 140 is connected to the third section 413. The feed conductor 120, the ground conductor 140 and the short conductor 150 are located on a second plane perpendicular to the ground element 130, and the first plane is perpendicular to the second plane.

In one embodiment, the length of the short conductor can be quarter of wavelength of a low band signal, and the impedance bandwidth for low frequency bands can therefore be further increased. The short conductor can be taken as an impedance matching circuit, which provides impedance matching via capacitance and inductance effects generated thereby to improve impedance matching effect and impedance bandwidth of the antenna module.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module, comprising:

a radiator;

a feed conductor, connected to the radiator;

a ground element;

a ground conductor, connecting to the radiator and the ground element; and a short conductor, connecting to the feed conductor and the ground conductor, wherein the radiator comprises a first section, a second section and a third section, the first section is connected to the third section, and the second section is connected to the third section, wherein the first section extends away from the third section in a first direction, then turns in a second direction perpendicular to the first direction, and then turns back in a third direction opposite to the first direction to a first free end, wherein the second section extends longitudinally from the third second to a second free end, and the first free end faces the second free end, and a T shaped groove is formed on the radiator, and the T shaped groove is defined by the first section, the second section and the third section, wherein the radiator further comprises a first extension section and a second extension section, the first extension section is connected to the first free end, and the second extension section is connected to the second free end, the first extension section is L shaped, the second extension section extends longitudinally from the second free end, and the first extension section and the second extension section are located on a first plane perpendicular to the ground element.

2. The antenna module as claimed in claim 1, wherein the ground conductor is parallel to the feed conductor.

3. The antenna module as claimed in claim 2, wherein the short conductor is respectively perpendicular to the ground conductor and the feed conductor.

4. The antenna module as claimed in claim 1, wherein a gap is formed between the short conductor and the third section.

5. The antenna module as claimed in claim 1, wherein the short conductor, the feed conductor, the ground conductor and the third section form a first opening, and the short conductor, the feed conductor, the ground conductor and the ground element form a second opening.

6. The antenna module as claimed in claim 5, wherein the first opening is rectangular.

7. The antenna module as claimed in claim 1, wherein the feed conductor, the ground conductor and the short conductor are located on a second plane perpendicular to the ground element, and the first plane is perpendicular to the second plane.

* * * * *